US008227057B2

(12) United States Patent
Wang

(10) Patent No.: US 8,227,057 B2
(45) Date of Patent: Jul. 24, 2012

(54) CORRUGATED PAPER SHEET BUFFER ARTICLE

(75) Inventor: Tao Wang, Beijing (CN)

(73) Assignee: Beijing Boe Optoelectronics Technology Co., Ltd., Beijing (CN)

( * ) Notice: Subject to any disclaimer, the term of this patent is extended or adjusted under 35 U.S.C. 154(b) by 335 days.

(21) Appl. No.: 12/561,384

(22) Filed: Sep. 17, 2009

(65) Prior Publication Data

US 2010/0075097 A1 Mar. 25, 2010

(30) Foreign Application Priority Data

Sep. 22, 2008 (CN) ..... 2008 1 0222693

(51) Int. Cl.
*B65D 5/49* (2006.01)
*B65D 81/05* (2006.01)

(52) U.S. Cl. ..... 428/34.2; 206/454; 206/521.5; 206/521.7; 206/593

(58) Field of Classification Search ..... 428/34.2, 428/57, 99; 206/454, 593, 521.7, 521.5
See application file for complete search history.

(56) References Cited

U.S. PATENT DOCUMENTS 6,837,421 B1 * 1/2005 Li et al. ..... 229/120.32
2008/0149519 A1 6/2008 Ting et al.

FOREIGN PATENT DOCUMENTS

CN 2480319 Y 3/2002
CN 2533092 Y 1/2003
CN 2759955 Y 2/2006
CN 2923566 Y 7/2007
JP 09-142448 A 6/1997

* cited by examiner

*Primary Examiner* — Alexander Thomas
(74) *Attorney, Agent, or Firm* — Ladas & Parry LLP

(57) ABSTRACT

A corrugated paper sheet buffer article for package comprising two tubular upper corner columns arranged in parallel, two tubular lower corner columns arranged below and in parallel with the two upper corner columns, and a plurality of spacing members arranged in parallel between the upper and lower corner columns. A plurality of first insertion grooves are provided along lengthwise directions of the upper and lower corner columns, respectively, and four corner ends of each of spacing members are inserted into the first insertion grooves on the upper and lower corner columns, respectively.

12 Claims, 3 Drawing Sheets

CORRUGATED PAPER SHEET BUFFER ARTICLE

BACKGROUND OF THE INVENTION

Embodiments of the present invention relate to a corrugated paper sheet buffer article for package.

In manufacturing liquid crystal displays (LCDs), the finished LCD panels are fragile, and thus before the finished LCD panels are transported, it is necessary to package the panels with a buffer article to prevent damage from collision.

The conventional buffer article for package is mainly made of foamed materials, e.g., expanded polypropylene (EPP), expandable polystyrene (EPS), etc. The production of these materials needs special forming molds, and vapor of high temperature and high pressure is applied to shape these materials, and in addition, antistatic material may be added for avoiding the disadvantages due to electrostatic discharge (ESD). Fractures may emerge on the used expanded polypropylene (EPP) material, and thus such used EPP material becomes unreliable and cannot be recycled any more. Expandable polystyrene (EPS) material is fragile and cannot be recycled after being used. As a result, the buffer article for package made of foamed materials is undesirable because of high cost, complicated manufacturing processes and long processing cycle, and these materials cannot be recycled after being used, which brings about significant pollution to the environment.

In order to overcome the above problems, a corrugated paper sheet may be employed as the material for manufacturing the buffer article due to its advantages of simple manufacturing processes and environmental-friendly characteristics. As shown in FIG. 1, a conventional corrugated paper sheet buffer article 10 is configured with two buffer members arranged opposite to each other. Two buffer members 11 are arranged opposite to each other and inserted into a bottom plate 13 at both ends of the bottom plate 13, and each buffer member 11 comprises a plurality of spacing member 12 arranged in parallel. An upper cover 14 of the same configuration and size with the bottom plate 13 can be put over or engaged with the spacing member 12 and is parallel with and opposite to the bottom plate 13. When a LCD panel is packed, one end of the LCD panel is inserted between the two spacing members 12 of one buffer member 11, and another end of the LCD panel is inserted between the corresponding two spacing members 12 of another buffer member 11.

The buffer article in such a configuration protects the LCD panels to a certain degree, but it does not have a stable structure. When external forces F1 and F2 are applied in different directions to the two buffer members 11 arranged opposite to each other, the two buffer members 11 can be twisted and deformed, which causes the LCD panel disposed therebetween faces the risks of friction and collision.

SUMMARY OF THE INVENTION

An embodiment of the present invention provides a corrugated paper sheet buffer article for package, comprising two tubular upper corner columns arranged in parallel, two tubular lower corner columns arranged below and in parallel with the two upper corner columns, and a plurality of spacing members arranged in parallel between the upper and lower corner columns. A plurality of first insertion grooves are provided along lengthwise directions of the upper and lower corner columns, respectively, and four corner ends of each of spacing members are inserted into the first insertion grooves on the upper and lower corner columns, respectively.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the following detailed description.

BRIEF DESCRIPTION OF THE DRAWINGS

The present invention will become more fully understood from the detailed description given hereinafter and the accompanying drawings which are given by way of illustration only, and thus are not limitative of the present invention and wherein.

DETAILED DESCRIPTION OF THE PREFERRED EMBODIMENTS

Further description about the embodiments of the present invention will be made with reference to the accompanying drawings.

Figure 1:
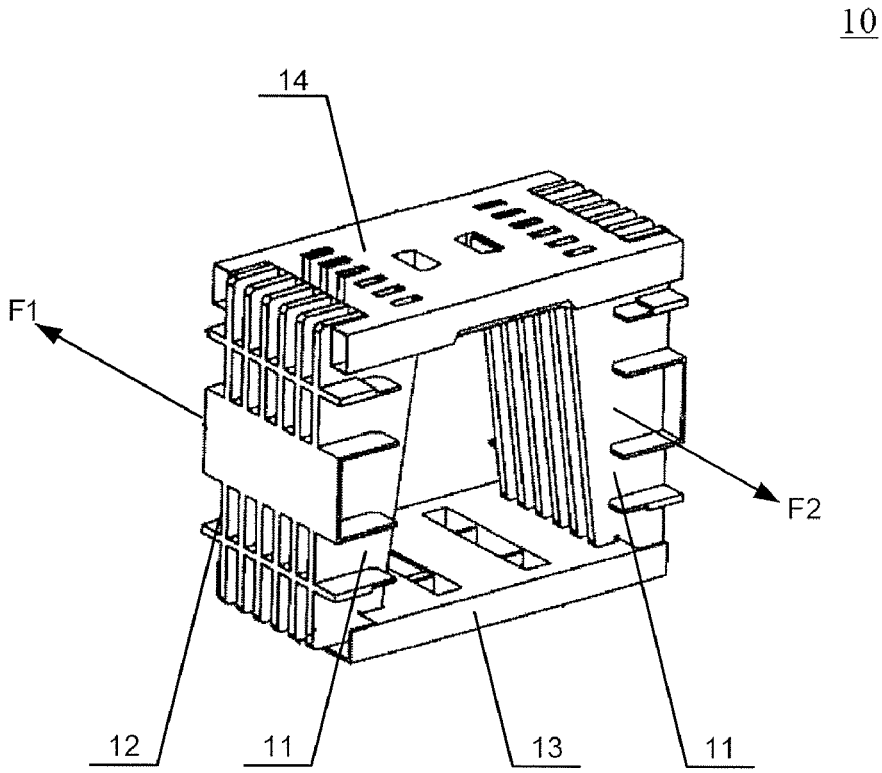
FIG.1 (Prior Art)
FIG. 1 is a schematic view showing the structure of a conventional corrugated paper sheet buffer article.
Figure 2:
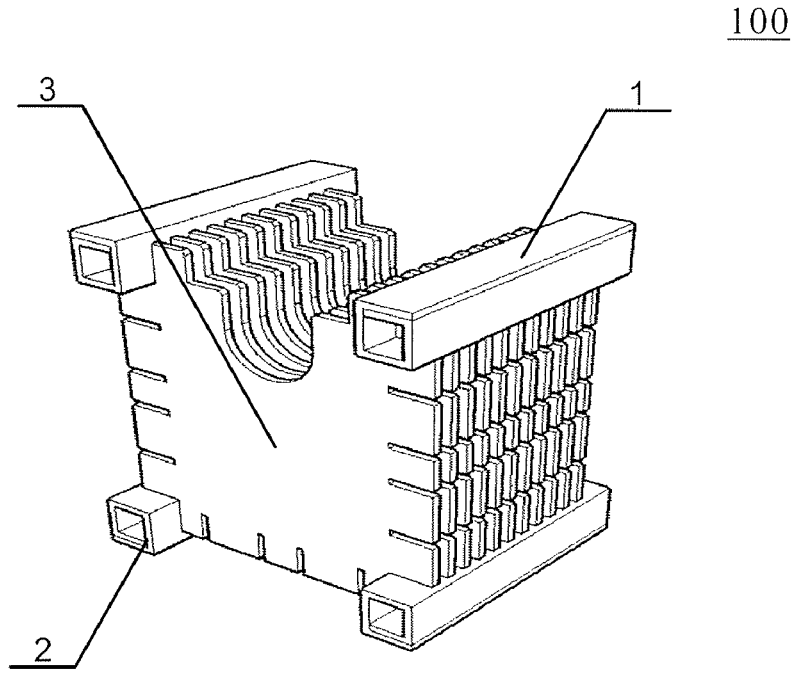
FIG. 2 is a schematic view showing the structure of a corrugated paper sheet buffer article according to a first embodiment of the present invention.

FIG. 2 is a schematic view showing a structure of a corrugated paper sheet buffer article 100 according to a first embodiment of the present invention. As shown in FIG. 2, the corrugated paper sheet buffer article for package comprises: two upper corner columns 1 arranged in parallel, having tubular shapes with rectangular cross-sections; two tubular lower corner columns 2 arranged below and in parallel with the upper corner columns 1, having the same configuration with the upper corner columns 1; and a plurality of spacing members 3 arranged in parallel between the upper and lower corner columns 1 and 2. The spacing members 3 are in a substantially rectangular shape. A plurality of first insertion grooves are provided in parallel along the lengthwise direction of the upper and lower corner columns 1 and 2, and the corner ends of each spacing member 3 are inserted into the respective first insertion grooves on the upper and lower corner columns 1 and 2. Each of the first insertion grooves extends in a direction perpendicular to the lengthwise direction of the upper and lower corner columns 1 and 2.

In the first embodiment, since a plurality of spacing members 3 are arranged in parallel with the length and width thereof are larger than those of the LCD panel to be packaged, the spacing members 3 rather than the LCD panel are subject to external force applied in the direction parallel to the spacing members 3. The upper and lower corner columns 1 and 2 can have hollow tubular shapes with a rectangular cross-section formed by bending a corrugated paper sheet, and the two upper and lower corner columns 1 and 2 in the same configuration are arranged in parallel with each other to form a rectangular parallelepiped profile with the spacing members 3. Since the configuration of the two upper and lower corner columns are the same, the corner columns can be manufactured in mass production and can be used as either the upper corner columns or the lower corner columns, which improves the production efficiency. In another embodiment, the upper corner columns 1 may have a different configuration from that of the lower corner columns 2.

The two upper corner columns 1 and the two tubular lower corner columns 2 are positioned at the four parallel edges of the formed rectangular parallelepiped profile respectively, with a plurality of first insertion grooves provided in parallel along the lengthwise directions of the upper corner columns 1 and the lower corner columns 2 on the inner side surfaces (i.e., the sides facing the spacing member 3) of the upper corner columns 1 and the lower corner columns 2, and the first insertion grooves extend perpendicular to the lengthwise direction of the upper corner columns 1 and the lower corner columns 2. The four corner ends of the plurality of spacing members 3 are inserted perpendicularly into the first insertion grooves of the upper corner columns 1 and the lower corner columns 2, so the upper corner columns 1 and the lower corner columns 2 rather than the LCD panel can be subject to external force applied in the direction perpendicular to the spacing members 3. The plurality of spacing members 3 isolate the LCD panels placed within the buffer article, so that the LCD panels cannot be damaged from friction and collision.

The corrugated paper sheet buffer article for package in the first embodiment can provide the following advantages: it provides strong supports in the directions in parallel with or perpendicular to the spacing members, so the external force applied in the parallel or perpendicular direction can be absorbed effectively, which protects the LCD panels disposed therein effectively; its structure is stable and cannot be twisted or deformed when external forces in different directions are applied; the LCD panels are separated by the spacing members and avoid damages from friction and collision; the buffer article can be assembled by insertion in a convenient way; and manufacturing processes are simple, environmental-friendly, and low-cost.

Figure 3:
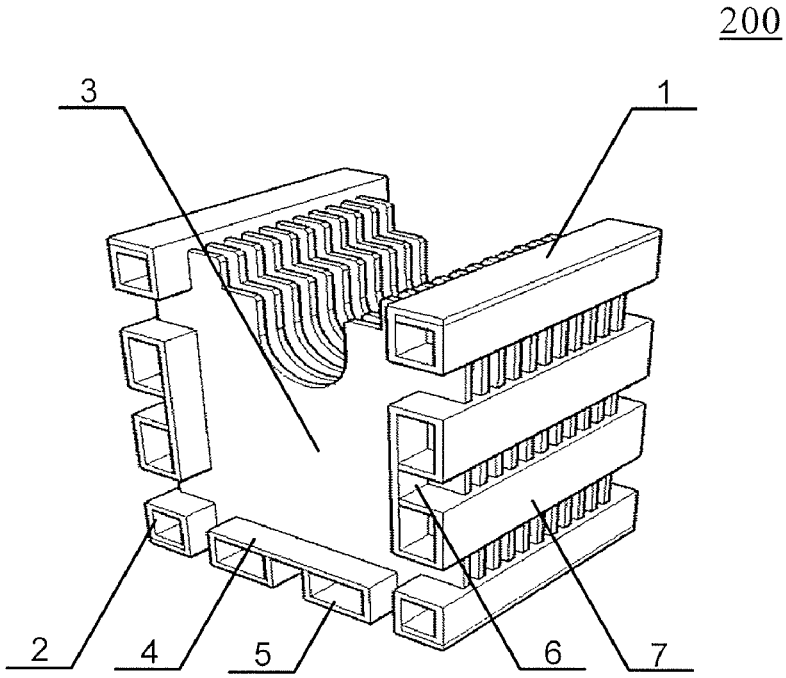
FIG. 3 is a schematic view showing the structure of a corrugated paper sheet buffer article according to a second embodiment of the present invention.

FIG. 3 is a schematic view showing the structure of a corrugated paper sheet buffer article 200 according to a second embodiment of the present invention. As shown in FIG. 3, in the second embodiment, besides the structure in the first embodiment, a lower board 4 is further provided between the two tubular lower corner columns 2 and comprises a plurality of first intermediate columns 5 having tubular shapes with rectangular cross-sections and laterally arranged side by side. The first intermediate columns 5 are disposed separately or integrally with their inner surfaces being connected with each other. A plurality of second insertion grooves are provided on the first intermediate columns 5, and the spacing members 3 are inserted into the second insertion grooves at the middle portion of the bottom sides of the spacing members 3.

In the second embodiment, the lower board 4 comprises a plurality of first intermediate columns 5 in parallel with the upper and lower corner columns 1 and 2, and each intermediate column 5 can have a tubular shape with a rectangular cross-section and can formed by bending a corrugated paper sheet. The plurality of first intermediate columns 5 are laterally arranged side by side and can be formed as an integral part with their inner surfaces (i.e., the upper surfaces) being connected with each other. On the upper surface of each of the first intermediate columns 5, a plurality of second insertion grooves are provided along the lengthwise direction of the first intermediate column 5 and each extends perpendicular to the lengthwise direction of the first intermediate column 5, and a plurality of spacing members 3 arranged in parallel are inserted perpendicularly into the second insertion grooves of the first intermediate columns 5 at the middle portion of the bottom sides of the spacing members 3, so the lower board 4 rather than the LCD panel can be subject to the external force which is perpendicular to the spacing member 3. As an alternative, the first intermediate columns 5 may be disposed separately from each other.

The lower board 4, into which the spacing members are inserted at the middle portion of the bottom sides, improves the support force perpendicular to the spacing members in the corrugated paper sheet buffer article for package of the present embodiment, which is effective in absorbing the external impact energy in the perpendicular direction. Moreover, the lower board 4 provides a support force in an upward direction to the LCD panel disposed thereon, and thus enhances the protection to the LCD panel.

Furthermore, as shown in FIG. 3, based on the structure of the above embodiment, a holder bracket 6 may be further provided between a pair of opposed upper corner columns 1 and the lower corner columns 2 and comprises a plurality of second intermediate columns 7 longitudinally arranged side by side and having tubular shapes with rectangular cross-sections. The plurality of second intermediate columns 7 are disposed in parallel with the upper and lower corner columns and separately or integrally with their inner side surfaces being connected with each other. A plurality of third insertion grooves are provided on the second intermediate columns 7, and the spacing members 3 are inserted into the third insertion grooves at the middle portion of the lateral sides of the spacing members.

In this embodiment, the holding bracket 6 comprises a plurality of second intermediate columns 7, and each intermediate column 7 can have a hollow tubular shape with a rectangular cross-section and can be formed by bending a corrugated paper sheet with the same lengthwise direction as those of the upper and lower corner columns and the first intermediate columns 5. The plurality of second intermediate columns 7 are longitudinally arranged side by side and formed as an integral part with their inner side surfaces (i.e., the left or right surfaces facing the spacing members 3) being connected with each other. On inner side surfaces of each of the second intermediate columns 7, a plurality of third insertion grooves are provided along the lengthwise direction of the second intermediate column 7 and extend perpendicular to the lengthwise direction, and a plurality of spacing members 3 in parallel arrangement are inserted perpendicularly into the third insertion grooves at the middle portions of the left and right sides of the spacing members 3, so the holding bracket 6 rather than the LCD panel can be subject to the external force which is perpendicular to the spacing member 3. As an alternative, the second intermediate columns 7 may be disposed separately. The lower board 4 and the holding bracket 6 may be in the same configuration, thus they can be produced in mass production and also may be used in assembling, and thereby the efficiency of production is improved.

The holding bracket engaged with the middle portion of the sides of the spacing members improves the support force in the direction perpendicular to the spacing members in the corrugated paper sheet buffer article for package of the present embodiment, which is effective in absorbing the external impact energy in the perpendicular direction, and further enhances the protection to the LCD panel.

Figure 4:
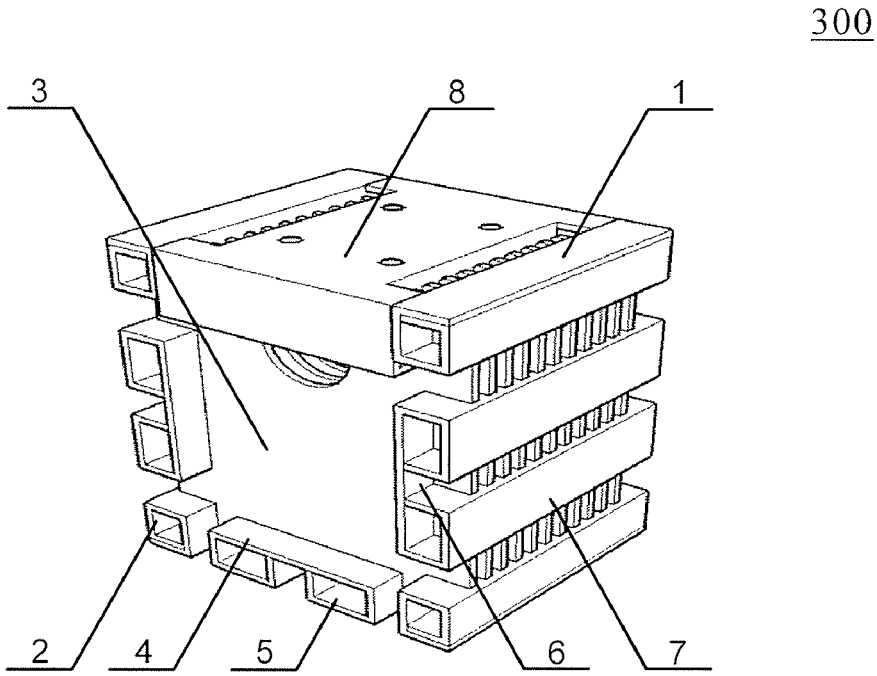
FIG. 4 is a schematic view showing the structure of a corrugated paper sheet buffer article according to a third embodiment of the present invention.

FIG. 4 is a schematic view showing the structure of a corrugated paper sheet buffer article 300 according to a third embodiment of the present invention. As shown in FIG. 4, in the third embodiment, besides the structure in the second embodiment, an upper board 8 is further provided between the two upper columns 1 and over the spacing members 3.

In the third embodiment, the upper board 8 is in a hollow flat rectangular parallelepiped configuration formed by bending a corrugated paper sheet, and is provided over the spacing members 3. When the buffer article inclines, the LCD panels can be prevented from dropping out of the buffer article by the upper board 8, thus the upper board 8 improves the protection to the LCD panel. The upper board 8 over the spacing members 3 is not engaged with the spacing members, so it is convenient to assemble and disassemble the upper board 8. Moreover, the upper board 8 is not limited by the configuration of the spacing members and has a wide applicability.

In all the above embodiments, the middle portion of the upper side of each spacing member 3 may have a recess in an arc concave shape, so that the LCD panel may be exposed from the arc concave recess, facilitating loading and unloading the LCD panels.

Furthermore, the spacing members 3 are provided on the lateral sides and/or bottom sides with a plurality of projected matching portions which can be inserted into the holding bracket 6 and lower board 4. The matching grooves can be correspondingly inserted into the second insertion grooves formed on the lower board 4 and the third insertion grooves formed on the holding bracket 6. If the matching grooves are provided on the bottom sides of the spacing members, the first intermediate columns 5 are provided with the second insertion grooves on their inner side surfaces and further possibly on the two surfaces adjacent to the inner side surfaces. If the matching grooves are provided on the lateral sides of the spacing members, the second intermediate columns are provided with the third insertion grooves on their inner side surfaces and further possibly on the two surfaces adjacent to the inner side surfaces. If the matching grooves are not provided on the bottom sides of the spacing members, it is necessary that the first intermediate columns are provided with the second insertion grooves on the inner side surfaces and the two surfaces adjacent to the inner side surfaces. If the matching grooves are not provided on the lateral sides of the spacing member, it is necessary that the second intermediate columns are provided with the third insertion grooves on its inner side surfaces and the two surfaces adjacent to the inner side surfaces.

Figure 5:
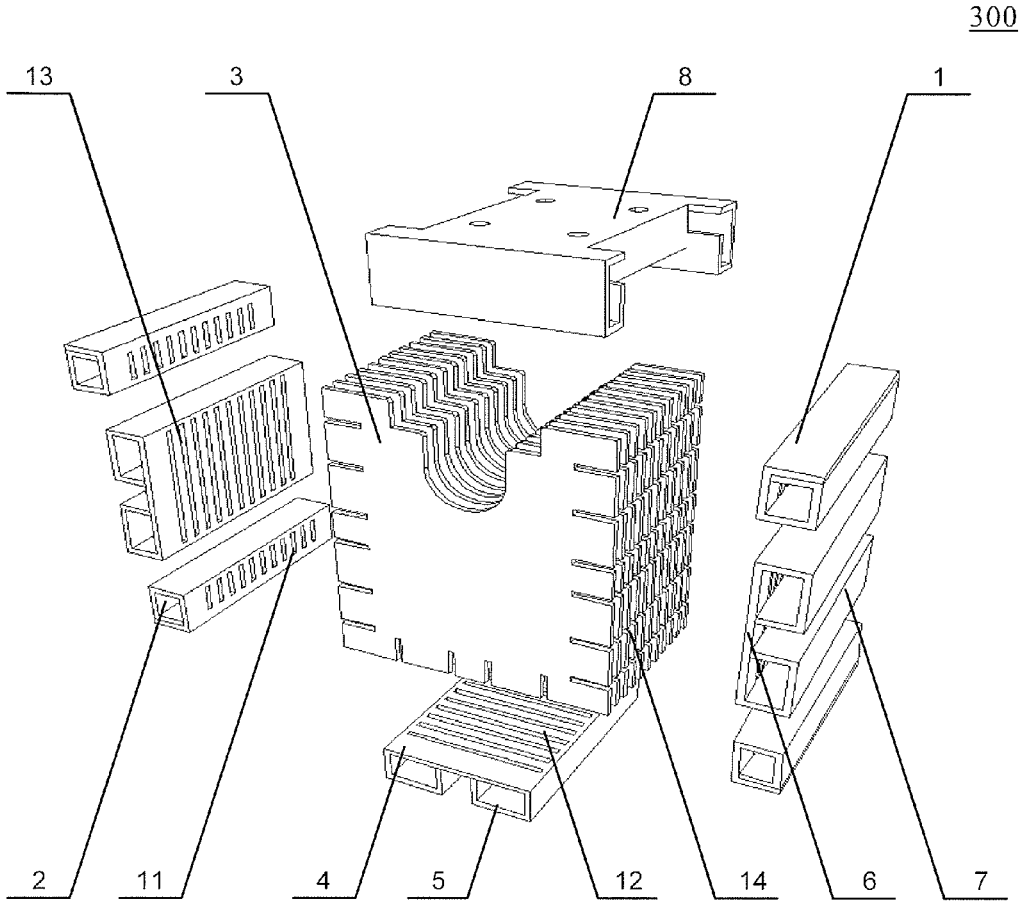
FIG. 5 is a schematic view showing the exploded state view of the corrugated paper sheet buffer article of the embodiment.

FIG. 5 is a schematic view showing the exploded state view of the corrugated paper sheet buffer article 300 of the third embodiment. As shown in FIG. 5, the corrugated paper sheet buffer article for package 300 comprises two upper corner columns 1, two tubular lower corner columns 2, a plurality of spacing members 3 arranged in parallel, a lower board 4, a holding bracket 6, and an upper board 8. A plurality of first insertion grooves 11 are disposed in parallel along the lengthwise direction of the upper corner columns 1 and the lower corner columns 2 with each groove extending perpendicular to the lengthwise direction. The lower board 4 comprises a plurality of first intermediate columns 5, and a plurality of second insertion grooves 12 are arranged in parallel along the lengthwise direction on the first intermediate column 5 with each groove extending perpendicular to the lengthwise direction. The holding bracket 6 comprises a plurality of second intermediate columns 7, and a plurality of third insertion grooves 13 are arranged in parallel along the lengthwise direction on the second intermediate column 7 with each groove extending perpendicular to the lengthwise direction. A plurality of projected matching portions 14 are arranged on the spacing member 3. In assembling, the upper corner ends of the plurality of spacing members 3 are inserted into the first insertion grooves 11 of the two upper corner columns 1, and the lower corner ends of the plurality of spacing members 3 are inserted into the first insertion grooves 11 of the two tubular lower corner columns 2 to form a rectangular parallelepiped configuration; the middle portions of the bottom sides of the plurality of spacing members 3 are inserted into the second insertion grooves 12 on the first intermediate columns 5, and the middle portions of the lateral sides of the plurality of spacing members 3 are inserted into the third insertion grooves 13 on the second intermediate columns 7; LCD panels can be disposed with each panel being between two adjacent spacing members 3; then, the upper board 8 can be arranged and over the spacing members 3 so as to form a corrugated paper sheet buffer article for package.

The above corrugated paper sheet buffer article for package has the following advantages: the external force applied in the parallel or perpendicular direction can be absorbed effectively, which protects the LCD panels disposed therein effectively; the structure in the embodiments is stable and is difficult to be twisted or deformed when external forces in different directions are applied, and even if it deforms, the LCD panels are separated by the spacing members and can avoid damages from friction and collision; the buffer article can be assembled by insertion in a convenient way; and manufacturing processes become simple, environmental-friendly, and low-cost.

In the embodiments of the present invention, the tubular shape of the corner columns and the intermediate columns are not limited to a tubular shape with a rectangular cross-section, which may be a tubular shape with a cross-section of a circular shape, an elliptical shape, and the like, and the configurations of the upper columns and lower columns are not limited to have the same configuration.

It should be appreciated that the embodiments described above are intended to illustrate but not limit the present invention. Although the present invention has been described in detail herein with reference to the preferred embodiments, it should be understood by those skilled in the art that the present invention can be modified and some of the technical features can be equivalently substituted without departing from the spirit and scope of the present invention.

What is claimed is:

1. A corrugated paper sheet buffer article for package comprising:

two tubular upper corner columns arranged in parallel, two tubular lower corner columns arranged below and in parallel with the two upper corner columns, and a plurality of spacing members arranged in parallel between the upper and lower corner columns, wherein a plurality of first insertion grooves are provided along a lengthwise directions of the upper and lower corner columns, respectively, and four corner ends of each of spacing members are inserted into the first insertion grooves on the upper and lower corner columns, respectively;

wherein a lower board is provided between the two tubular lower corner columns, the lower board comprises a plurality of first intermediate columns having tubular shapes and laterally arranged side by side, and the first intermediate columns are disposed separately or integrally with their inner surfaces being connected with each other; and a plurality of second insertion grooves are provided on the first intermediate columns, and the spacing members are inserted into the second insertion grooves at the middle portion of the bottom sides of the spacing members; and wherein an upper board is provided between the two tubular upper corner columns and over the spacing members, the upper board comprises a plurality of upper board columns having tubular shapes, the upper board columns are disposed separately, and the upper board is in a hollow flat rectangular parallelpiped configuration formed by bending a corrugated paper sheet.

2. The corrugated paper sheet buffer article for package according to claim 1, wherein a holder bracket is provided between a pair of opposed upper and lower corner columns.

3. The corrugated paper sheet buffer article for package according to claim 2, wherein the holder bracket comprises a plurality of second intermediate columns longitudinally arranged side by side and having tubular shapes, and the second intermediate columns are disposed separately or integrally with the inner side surfaces thereof being connected with each other;

a plurality of third insertion grooves are provided on the second intermediate columns, and the spacing members are inserted into the third insertion grooves at the middle portion of the lateral sides of the spacing members.

4. The corrugated paper sheet buffer article for package according to claim 3, wherein the second intermediate columns have a tubular shape having a cross-section selected from the group consisting of a rectangular shape, a circular shape and an elliptical shape.

5. The corrugated paper sheet buffer article for package according to claim 2, wherein the middle portion of the upper side of each of the spacing member has a recess in an arc concave shape.

6. The corrugated paper sheet buffer article for package according to claim 2, wherein the spacing member is provided on its lateral sides with a plurality of projected matching portions.

7. The corrugated paper sheet buffer article for package according to claim 1, wherein the middle portion of the upper side of each of the spacing member has a recess in an arc concave shape.

8. The corrugated paper sheet buffer article for package according to claim 1, wherein the middle portion of the upper side of each of the spacing member has a recess in an arc concave shape.

9. The corrugated paper sheet buffer article for package according to claim 1, wherein the spacing member is provided on its bottom side with a plurality of projected matching portions.

10. The corrugated paper sheet buffer article for package according to claim 1, wherein the tubular upper corner columns and the tubular lower corner columns have a tubular shape having a cross-section selected from the group consisting of a rectangular shape, a circular shape and an elliptical shape.

11. The corrugated paper sheet buffer article for package according to claim 1, wherein the first intermediate columns have a tubular shape having a cross-section selected from the group consisting of a rectangular shape, a circular shape and an elliptical shape.

12. The corrugated paper sheet buffer article for package according to claim 1, wherein the configurations of the upper columns and lower columns are of the same configuration.

* * * * *